US007025107B2

(12) United States Patent
Ciuca

(10) Patent No.: US 7,025,107 B2
(45) Date of Patent: Apr. 11, 2006

(54) ONE-WAY TENSIONING MECHANISM FOR CORDLESS BLIND

(75) Inventor: Zazu Ciuca, Jamestown, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 0 days.

(21) Appl. No.: 09/918,905

(22) Filed: Jul. 31, 2001

(65) Prior Publication Data

US 2003/0024656 A1 Feb. 6, 2003

(51) Int. Cl.
*E06B 9/322* (2006.01)

(52) U.S. Cl. ..... 160/170

(58) Field of Classification Search ..... 160/170 R, 160/171 R, 191, 192; 242/373, 375.1, 377, 242/378.1, 397.5, 381.4, 382.6, 388.2, 388.3, 242/388.5

See application file for complete search history.

(56) References Cited

U.S. PATENT DOCUMENTS

| | | | | |
|---|---|---|---|---|
| 948,239 | A | | 2/1910 | McManus |
| 1,215,985 | A | | 2/1917 | Plate |
| 1,669,255 | A | | 5/1928 | Landry |
| 1,721,501 | A | | 7/1929 | McKee |
| 1,804,811 | A | | 5/1931 | Rosel |
| 1,863,620 | A | * | 6/1932 | Carouso |
| 2,049,518 | A | | 8/1936 | Schier |
| 2,053,356 | A | | 9/1936 | Wiener |
| 2,129,606 | A | | 9/1938 | Nisenson |
| 2,132,991 | A | | 10/1938 | Mintz |
| 2,172,657 | A | | 9/1939 | Haase |
| 2,175,977 | A | | 10/1939 | Stuber et al. |

(Continued)

FOREIGN PATENT DOCUMENTS

DE DE 40 03 218 A1 8/1991

(Continued)

OTHER PUBLICATIONS

F.A. Votta, The Theory and Design of Long-Deflection Constant-Force Spring Elements, Transactions of the Asme, May 1952, pp. 439-450.

*Primary Examiner*—Blair M. Johnson
(74) *Attorney, Agent, or Firm*—Marshall, Gerstein & Borun LLP

(57) ABSTRACT

A cordless blind comprising a headrail, a bottom rail suspended from the headrail by a first cord and a second cord. A window covering disposed between the headrail and the bottom rail, a drive actuator including a spring motor and a spool for accumulating the cords is coupled to the spring motor. A one-way tensioning mechanism is mounted and coupled to the drive actuator and the bottom rail wherein the tensioning mechanism is configured to provide a resistant force on movement of one of the first and second cords in one direction. Another embodiment of the cordless blind provides the one-way tensioning mechanism comprising a mechanism bracket with the mechanism bracket having a base and a first upright and second upright coupled to the base. Each upright defines an aperture proximate a distal end of each upright and further each upright including a pawl with one pawl aligned in facing relationship with the other pawl. A pulley is mounted between the two uprights. The pulley has a cylinder with a sidewall at each end of the cylinder with each sidewall having an interface and an outerface. Each outerface has a plurality of ratchet teeth configured to selectively engage the pawl on each upright. The pulley is configured to move within the apertures to one of a free-wheeling position and a stopped position.

30 Claims, 4 Drawing Sheets

U.S. PATENT DOCUMENTS

| | | | | |
|---|---|---|---|---|
| 2,250,106 | A | 7/1941 | Lorentzen | 156/17 |
| 2,266,160 | A | 12/1941 | Burns | |
| 2,276,716 | A | 3/1942 | Cardona | 156/17 |
| 2,324,536 | A | 7/1943 | Pratt | |
| 2,390,826 | A | 12/1945 | Cohn | 160/170 |
| 2,410,549 | A | 11/1946 | Olson | 160/34 |
| 2,420,301 | A | 5/1947 | Cusumano | 160/34 |
| 2,609,193 | A | 9/1952 | Foster | |
| 2,732,010 | A | 1/1956 | Griesser | |
| 2,824,608 | A | 2/1958 | Etten | 160/170 |
| 3,727,665 | A | 4/1973 | Debs | |
| 3,744,544 | A | 7/1973 | Wellensiek | |
| 3,799,236 | A | 3/1974 | Debs | |
| 3,918,513 | A | 11/1975 | Englund et al. | |
| 3,931,846 | A | 1/1976 | Zilver | |
| 3,952,789 | A | 4/1976 | Marotto | |
| 4,039,020 | A | 8/1977 | Jacobson | |
| 4,245,688 | A | 1/1981 | Vecchiarelli | |
| 4,250,597 | A | 2/1981 | Ford et al. | |
| 4,327,797 | A | 5/1982 | Nakajima et al. | |
| 4,352,386 | A | 10/1982 | Butler et al. | |
| 4,398,585 | A | 8/1983 | Marlow | |
| 4,476,909 | A | 10/1984 | Anderle et al. | |
| 4,487,243 | A | 12/1984 | Debs | |
| 4,488,588 | A | 12/1984 | McClure | |
| 4,574,864 | A | 3/1986 | Tse | |
| 4,610,292 | A | 9/1986 | Hausmann et al. | 160/120 |
| 4,623,012 | A | 11/1986 | Rude et al. | 160/243 |
| 4,647,488 | A | 3/1987 | Schnebly et al. | 428/116 |
| 4,649,982 | A | 3/1987 | Baumann et al. | |
| 4,674,550 | A | 6/1987 | Graves | |
| 4,722,383 | A | 2/1988 | Kross | |
| 4,776,381 | A | 10/1988 | Riddiford | |
| 4,862,941 | A | 9/1989 | Colson | |
| 4,877,075 | A | 10/1989 | Markowitz | 160/84.1 |
| 4,880,045 | A | 11/1989 | Stahler | 160/84.1 |
| 4,884,618 | A | 12/1989 | Steeves | |
| 4,945,970 | A | 8/1990 | Marocco | |
| 4,955,421 | A | 9/1990 | Torti | 160/243 |
| 4,982,776 | A | 1/1991 | Kuhar et al. | |
| 5,054,162 | A | 10/1991 | Rogers | 16/198 |
| 5,067,541 | A | 11/1991 | Coslett | |
| 5,103,888 | A | 4/1992 | Nakamura | 160/171 |
| 5,105,867 | A | 4/1992 | Coslett | |
| 5,133,399 | A | 7/1992 | Hiller et al. | 160/171 |
| 5,143,135 | A | 9/1992 | Kuhar | |
| 5,170,830 | A | 12/1992 | Coslett | |
| 5,184,660 | A | 2/1993 | Jelic | 160/171 |
| 5,228,491 | A | 7/1993 | Rude et al. | 160/171 |
| 5,274,357 | A | 12/1993 | Riordan | 340/550 |
| 5,285,838 | A | 2/1994 | Rapp et al. | |
| 5,297,608 | A | 3/1994 | Rap et al. | |
| 5,316,066 | A | 5/1994 | Rapp et al. | |
| 5,413,161 | A | 5/1995 | Corazzini | 160/7 |
| 5,482,100 | A | 1/1996 | Kuhar | 160/168.1 |
| 5,482,105 | A | 1/1996 | Rude | |
| 5,531,257 | A | 7/1996 | Kuhar | 160/168.1 |
| 5,623,982 | A | 4/1997 | Okazaki | |
| 5,664,614 | A | 9/1997 | Debs | |
| 5,671,793 | A | 9/1997 | Lee | |
| 5,799,715 | A | 9/1998 | Biro et al. | |
| 5,853,040 | A | 12/1998 | Benthin | |
| 5,960,846 | A | 10/1999 | Lysyj | |
| 6,012,506 | A | 1/2000 | Wang et al. | 160/170 |
| 6,024,154 | A * | 2/2000 | Wang et al. | 160/170 |
| 6,029,734 | A | 2/2000 | Wang et al. | |
| 6,032,716 | A | 3/2000 | Mattey | |
| 6,047,759 | A | 4/2000 | Lysyj | |
| 6,056,036 | A | 5/2000 | Todd et al. | 160/84.05 |
| 6,079,471 | A | 6/2000 | Kuhar | 160/170 |
| 6,095,222 | A | 8/2000 | Voss | 160/84.05 |
| 6,112,800 | A | 9/2000 | Marusak | |
| 6,135,189 | A | 10/2000 | Weinreich | 160/191 |
| 6,149,094 | A | 11/2000 | Martin et al. | 242/373 |
| 6,234,236 | B1 | 5/2001 | Kuhar | 160/170 |
| 6,283,192 | B1 * | 9/2001 | Toti | 160/170 |
| 6,330,899 | B1 | 12/2001 | Ciuca et al. | |
| 6,644,375 | B1 * | 11/2003 | Palmer | 160/84.04 |
| 2002/0033241 | A1 * | 3/2002 | Palmer | 160/170 |
| 2002/0088562 | A1 * | 7/2002 | Palmer | 160/170 |
| 2002/0157796 | A1 * | 10/2002 | Judkins | 160/84.04 |

FOREIGN PATENT DOCUMENTS

| | | |
|---|---|---|
| EP | 1039092 A2 | 9/2000 |
| FR | 883 709 | 7/1943 |
| FR | 2 337 809 | 8/1977 |

* cited by examiner 14
38
36
2
20
2
22
24
38
18
26
28
26
28
33
24
12
42
18
34
32
18
40
40
30
18
30
32
16

FIG. 2
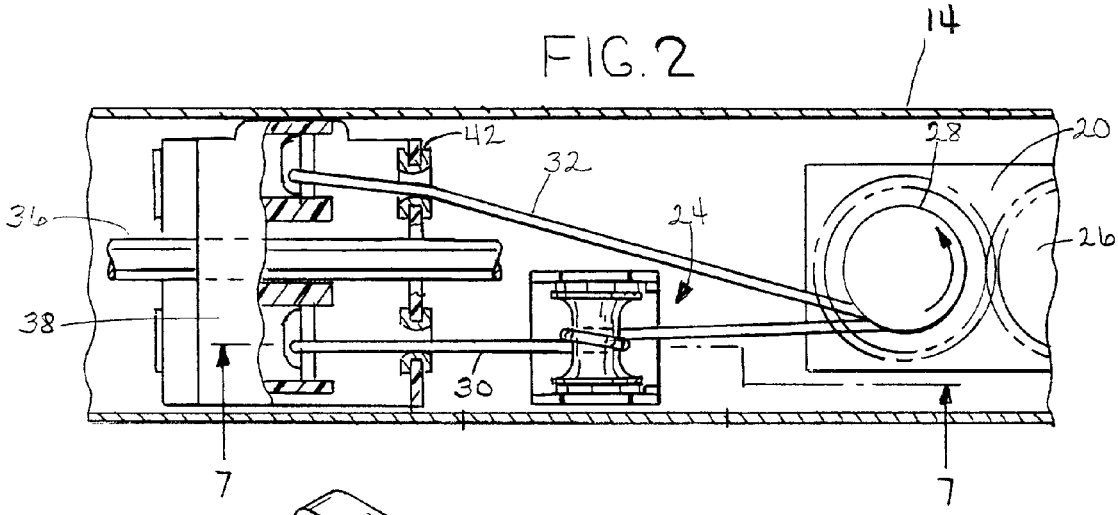
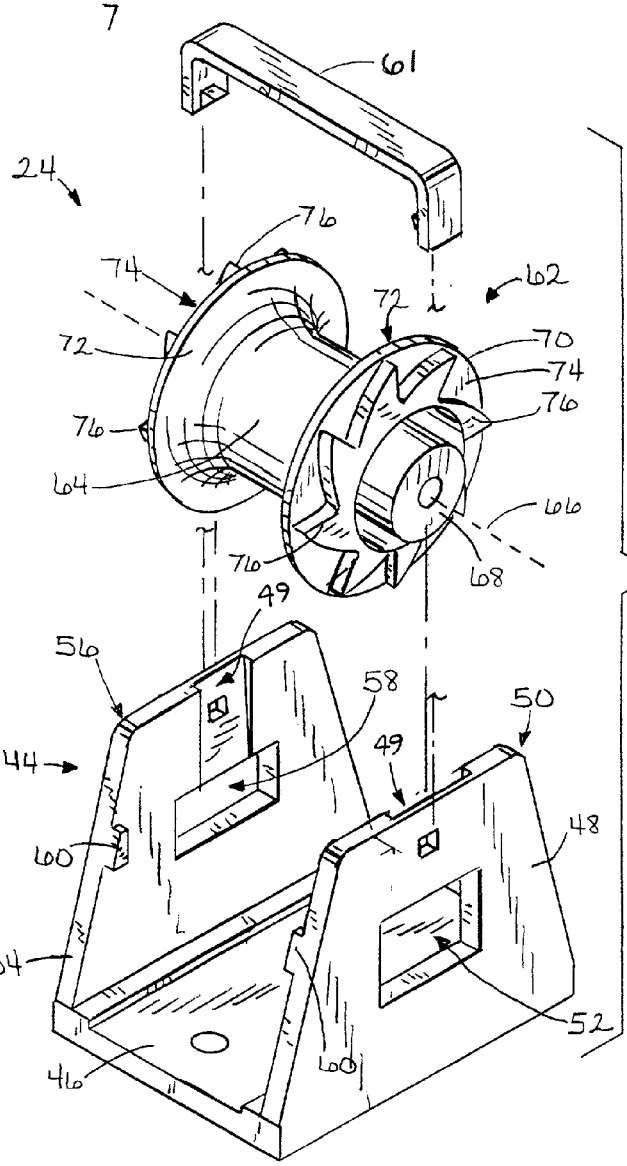
FIG. 3

ONE-WAY TENSIONING MECHANISM FOR CORDLESS BLIND

FIELD OF THE INVENTION

This invention relates to a window furnishing and more particularly to a one-way tensioning mechanism for a cordless blind.

BACKGROUND OF THE INVENTION

Venetian blinds are well known and typically include a head rail, a bottom rail, and a plurality of slats arranged between the headrail and the bottom rail. The slats are typically made from a variety of materials, such as metal, wood, plastic or other materials and supported by ladders.

Such blinds also typically include a tilt mechanism to enable the slats to move from a horizontal position to a nearly vertical position to open and close the blinds to affect the passage of light. As is also conventional with such systems, flexible line members or lift cords are coupled to the bottom rail, pass through the slats or adjacent the edges of the slats and into mechanisms within an upper headrail. The cords are employed to raise the bottom rail, accumulating individual slats as the bottom rail is raised. Because of gravity, the natural tenancy of the bottom rail and accumulated slat weight is to free fall. In many instances in the prior art, cord lock mechanisms are employed to lock the cord, thereby setting bottom rail, and the slats stacked thereon at a height determined by the user. Pleated and other types of shades also include a bottom rail and include similar raising and lowering lift cord members and a cord lock mechanism.

Blinds and shades that use a cord lock mechanism typically include a portion of the lift cord that extends from the cord lock and is external to the blind or shade. This external portion of the lift cord may pose a danger to small children or pets. A cordless blind, such as the one disclosed in U.S. Pat. No. 5,482,100 to Otto Kuhar eliminates the need for a cord lock and the resulting external portion of the lift cord. The cordless blind may employ a spring motor to assist in the balance of the bottom rail and accumulated window covering material.

Spring motors used in cordless blinds may comprise a flat ribbon of spring metal which is pre-stressed and coiled so as to have a natural or relaxed state in which the spring forms a tightly wound coil disposed on or in a spring storage or take up drum. The extended free end of the coil is attached to the hub of an output or spring drive drum onto which the spring is backwound by rotating the output drum in a direction to back or reverse wind the spring thereon. When the load to which the output drum is connected is released, the curling property of the spring causes it to rewind onto or into the storage drum toward its natural or relaxed state. Such spring motors as descried above can be of constant or variable force, depending upon the intended use of the motor. Other type of spring motors may also be used.

In connection with the use of such a spring motor and a venetian blind, as an example, a control drum or spool is coupled to one of the storage or output drum for rotation therewith. Depending on the number and location of the lift cords, the lift cords may be attached to a single spool or to two or more spools. The flexible member or lift cords are wound onto the spool in a direction which provides for the unwinding of the cords to rotate the spring output drum in the direction for winding the spring member thereon from the spring storage drum.

When the bottom rail is lowered, the cords unwind from the spool or spools thus driving the spring output drum to wind the spring member thereon. Upward displacement of the bottom rail toward the head rail from a lowered position results in the spring member rewinding on the spring storage drum to rotate the spring output drum and thus the spools in the direction to rewind the cords. In elevating and lowering a suspended load of the foregoing example type, which is too heavy to provide desire displacement characteristics in connection with the upward and downward movement of the bottom rail, and using a single spring motor, many times it is necessary to provide a larger spring motor or operate two or more spring motors in tandem.

If the spring motor has a spring force that varies such that the force increases as the bottom rail is moved toward the head rail, the spring force may balance the increased weight of the window covering that accumulates on the bottom rail as it is raised. However, if the spring force is a constant force then the spring force and weight of the bottom rail and accumulated window covering may not be in balance for the full range of positions of the bottom rail relative to the head rail.

If a spring motor is selected with a spring having a spring force sufficient to maintain the bottom rail and accumulated window covering in the raised position, the spring force may be excessive when the bottom rail is in the lowered position. As a result the bottom rail may creep upward until the cordless blind system is in balance. Creep being the movement of the bottom rail relative to the head rail away from the desired position as set by an operator of the blind.

Because of the difference in materials of the slats, the size of the blind, the number of slats in the blind, the weight of the parts plus the weight of the bottom rail, etc., the motor must have different characteristics and be designed for different loads. To avoid having to design a separate motor for each type or combination of blind components, a balance of forces, typically in friction forces, within the blind system is desired. Where the spring force is sufficient to maintain the bottom rail and accumulated window covering in the raised position, but to strong to allow the bottom rail to maintain its position in the lowered position, additional friction is required. However, the additional friction is only required in a single direction to avoid upward creep.

Thus there is a need for a cordless blind that will provide a balance of forces to avoid creep of the bottom rail. There is a further need for a friction applying system that will provide one-way tension to a cord in a blind system. There is a further need for a blind system that includes a mechanism for providing a resistant force on cord movement in one direction and a free-wheeling capability on the cord in another direction.

It would be desirable to provide a blind with or providing any one or more of these or other advantageous features.

SUMMARY OF THE INVENTION

One embodiment provides a cordless blind comprising a headrail, a bottom rail suspended from the headrail by a first cord and a second cord. A window covering disposed between the headrail and the bottom rail, a drive actuator including a spring motor and a spool for accumulating the cords is coupled to the spring motor. A one-way tensioning mechanism is mounted and coupled to the drive actuator and the bottom rail wherein the tensioning mechanism is configured to provide a resistant force on movement of one of the first and second cords in one direction. Another embodiment of the cordless blind provides the one-way tensioning mechanism comprising a mechanism bracket with the mechanism bracket having a base and a first upright and second upright coupled to the base. Each upright defines an aperture proximate a distal end of each upright and further each upright including a pawl with one pawl aligned in facing relationship with the other pawl. A pulley is mounted between the two uprights. The pulley has a cylinder with a sidewall at each end of the cylinder with each sidewall having an interface and an outerface. Each outerface has a plurality of ratchet teeth configured to selectively engage the pawl on each upright. The pulley is configured to move within the apertures to one of a free-wheeling position and a stopped position.

Another embodiment provides a one-way tensioning mechanism in a cordless blind with the cordless blind having a headrail, a bottom rail suspended from the headrail by a first cord and a second cord, a window covering disposed between the headrail and the bottom rail, a drive actuator including—a spring loader and a spool for accumulating the cords coupled to the spring loader. A one-way tensioning mechanism is coupled to one of the first cord and the second cord. The one-way tensioning mechanism comprises a mechanism bracket with the mechanism bracket having a base and a first upright and a second upright coupled to the base. Each upright defines an aperture proximate to the distal end of each upright and further each upright including a pawl, with one pawl aligned in facing relationship with the other pawl. A pulley is mounted between the two uprights with the pulley having a cylinder with the sidewall on each end of the cylinder. Each sidewall has an interface and an outerface with each outerface having a plurality of ratchet teeth configured to selectively engage the pawl on each upright. The tensioning mechanism is configured to provide a resistant force on movement of one of the first and second cords in one direction. The spool is configured to move within the apertures to one of a free wheeling position and stopped position. Another embodiment of the one-way tensioning mechanism provides the base and two uprights formed as a single integral piece. More than one one-way tensioning mechanism may be provided.

A further embodiment additionally provides a cordless blind comprising a headrail and a bottom rail suspended from the headrail by a first and second cord. A window covering is disposed between the headrail and the bottom rail with a means for actuating coupled to the cords. The means for providing a resistant force on movement of one of the first and second cords in one direction is also provided. The means for providing a resistant force comprises a means for supporting, including a means for engaging and a means for tensioning coupled to the means for supporting, with the means for tensioning configured to selectively engage the means for engaging. The means for tensioning is configured to move within the means for supporting to one of a free-wheeling position and a stopped position. The means for supporting includes a first aperture and a second aperture with the first aperture sized different from the second aperture.

A still further embodiment provides a method for providing a resistant force in a cordless blind. The method comprises the steps of providing a cordless blind, the blind having a headrail, a bottom rail suspended from the headrail by a first cord and a second cord and a window covering disposed between the headrail and the bottom rail. A drive actuator including a spring motor and a spool are accumulating the cords is also provided in the cordless blind. The method further includes installing a one-way tensioning mechanism in the headrail and winding one of the first cord and the second cord around a pulley. The pulley is provided with ratchet teeth mounted in the one-way tensioning mechanism. The method also includes providing at least one pawl on the tensioning mechanism with the pawl aligned to selectively engage the ratchet teeth of the pulley. The pulley is configured to move within the tensioning mechanism to one of a free-wheeling position and a stopped position. Another embodiment includes the steps of installing a second one-way tensioning mechanism and in the headrail of the cordless blind and winding the other of the first and second cords around a second pulley, with that second pulley having a plurality of ratchet teeth mounted in the second one-way tensioning mechanism.

A further embodiment provides a cordless blind comprising a headrail and a bottom rail operatively coupled to the headrail with at least one cord. A window covering is disposed between the headrail and the bottom rail. A pulley is operatively engaged with the cord and with the pulley being rotatable in only one direction.

A further embodiment provides a cordless blind comprising a headrail and a bottom rail operatively coupled to the headrail with at least one cord. A window covering is disposed between the headrail and the bottom rail. A tensioner is operatively engaged with the cord applying a first frictional force opposing movement of the cord in only one direction.

BRIEF DESCRIPTION OF THE DRAWINGS

FIG. 2 is a fragmentary top view of the top rail of the cordless blind illustrated in FIG. 1 along the line 2—2, including a one-way tensioning mechanism.

FIG. 3 is an exploded, perspective view of an exemplary embodiment of a one-way tensioning mechanism.

DETAILED DESCRIPTION OF THE PREFERRED EMBODIMENTS

The exemplary embodiments shown in the Figures relate generally to the art of a one-way tensioning mechanism, including window coverings such as venetian blinds and window shades. More specifically, the present exemplary embodiments relate to a one-way tensioning mechanism to attain one or more desired performance characteristics.

Performance characteristics of a blind may include the effort necessary to raise or lower the bottom rail, the speed of which the bottom rail may be raised or lowered, and whether the bottom rail remains in a static position relative to the head rail when released (i.e., "balanced"). Movement of the bottom rail after it is released is referred to as "creep". The performance characteristics of the blinds and drive actuators shown in the Figures may depend on the customers preferences, and may be variable, selectable, and adjustable by a retail sales associate, the installer, and/or the customer.

As shown in the Figures, the blind is configured to be balanced at any of a variety of times (e.g., after a test operation at a retail sales location, after customization which may be done at the point of sale or prior to installation or the like after installation, periodically during its life, etc). A balanced blind is one that maintains the position of the bottom rail at any position or location between a fully lowered (wherein the window is covered) and fully raised position (where the window is uncovered) relative to the headrail when released by the operator. Movement of the bottom rail toward or away from the headrail after the bottom rail has been released by the operator is referred to as creep.

The performance characteristics, particularly whether a blind is "balanced," depends on a number of variables including weight of the bottom rail plus any accumulated window covering ("ΣW"), force of the spring motor ("Fs"), and frictional force (both "naturally" occurring friction and friction "added" to the system collectively referred to as f). A blind is balanced when the friction force is greater than the absolute value of the difference of the weight and the spring motor force (i.e., $f>|\Sigma W-Fs|$).

Figure 1:
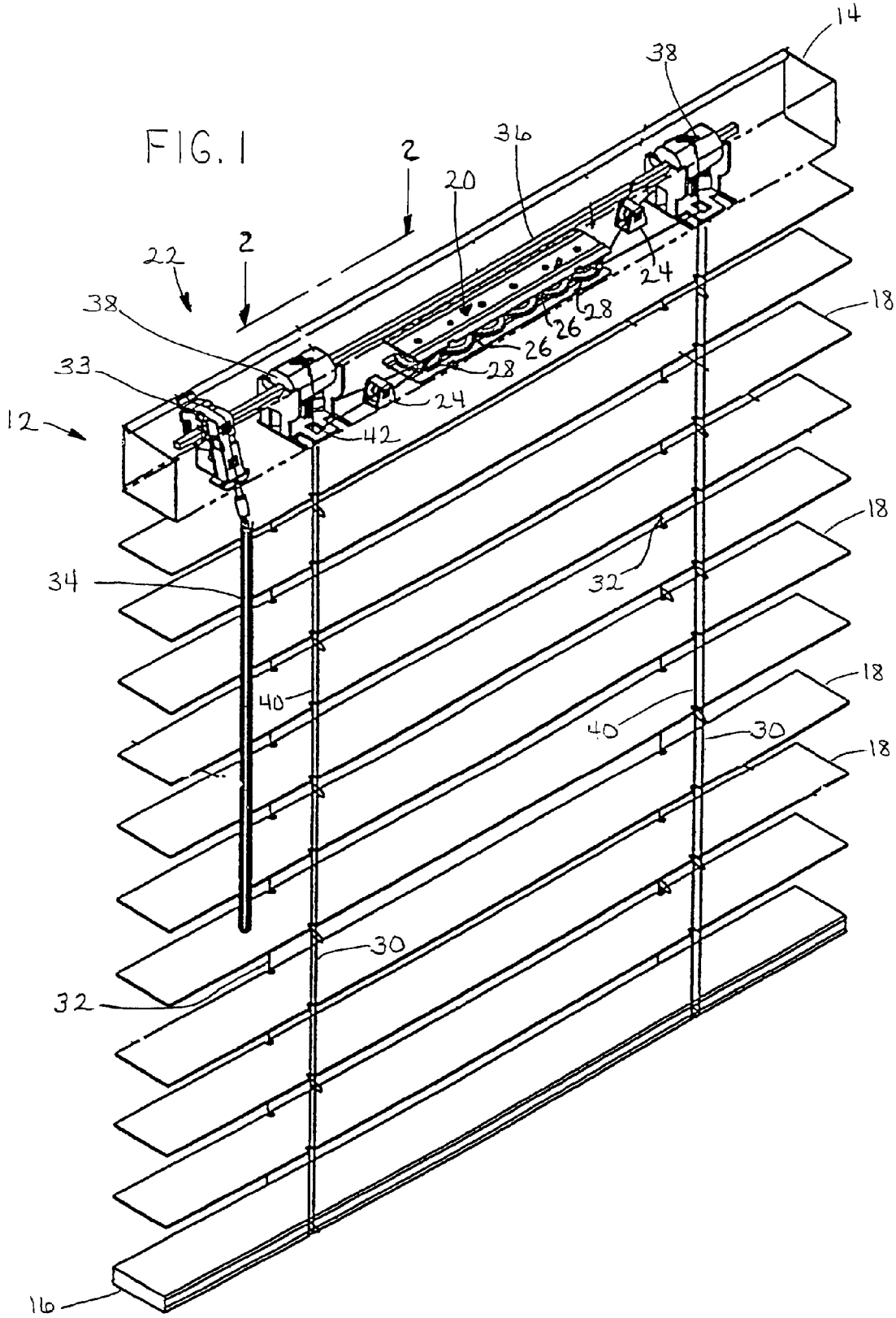
FIG. 1 is a perspective view of an exemplary embodiment of a cordless blind.

Referring to FIG. 1, blind 12 provides spring motor 26 mounted in a horizontal configuration and located in head rail 14. Such a horizontal configuration is intended to decrease the overall height of head rail 14. The spring motor 26 can also be mounted in the bottom rail 16. When bottom rail 16 is in a lowered position, slats 18 are independently supported from head rail 14 by a flexible ladder and are evenly vertically spaced from one another. Bottom rail 16 may be connected to terminal ends of the flexible ladder. As bottom rail 16 is raised, slats 18 stack upon one another and are supported by bottom rail 16. Bottom rail 16 and the stacked slats 18 are supported by first and second cords 30, 32 on each end of the bottom rail. The first and second cords 30, 32 on each end are located proximate the longitudinal edges of the slats. Depending on the type of slats and size of the blind, other cord configurations may also be employed. As illustrated in FIG. 1 first and second cords 30, 32 of each end of the blind 12 are coupled to the spring motor 26 mounted in head rail 14 via a respective cord spool 28.

Figure 7:
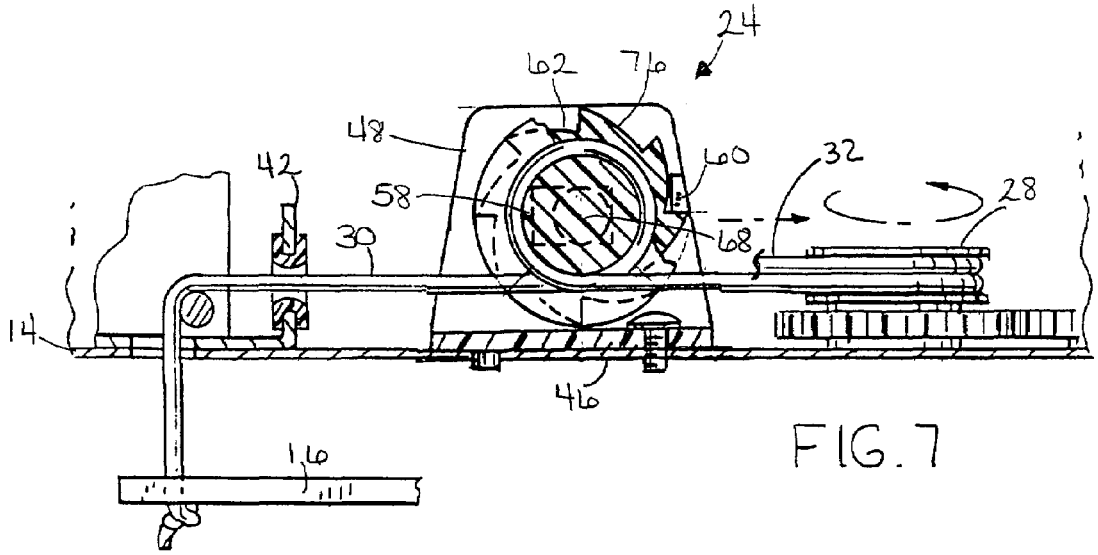
FIG. 7 is a sectional view of the one-way tensioning mechanism in the head rail of the cordless blind illustrated in FIG. 2 along the line 7—7, with the pulley of the one-way tensioning mechanism in the stopped position and the bottom rail in a stopped position.

Each cord spool 28 is coupled to the spring motor such that rotation of the cord spool results in rotation of the spring motor. As shown in FIG. 1, drive actuator 20 includes two spring motors 26, with one cord spool 28 attached to a respective spring motor 26. However, a single spring motor could also be employed, with the cord spools being coupled to either end of the spring motor. As shown in FIG. 7 cords 30, 32 are wound about a single spool, with each cord being wound on the spool separated by a flange.

In FIG. 1, spring motor 26 and the cord spools 28 are mounted such that their axes are in a vertical position. Such a configuration gives an overall appearance of the drive actuator 20 as a horizontal spring mount configuration located in head rail 14. To adjust blind 12, the user grasps bottom rail 16 and raises or lowers it to the desired position. (See FIGS. 8 and 9) Raising bottom rail 16 allows spring tension in spring member to wind or collect spring member about the storage drum so that first and second cord 30, 32 may be collected by their respective cord spools 28.

The blind 12 may be provided with a tilt mechanism 22 as shown in FIGS. 1 and 2. The tilt mechanism 22 includes a tilt drum 38 mounted on a tilt drum bracket 42. A ladder cord 40 is coupled to each of the slats on the window covering 18 and terminates by engaging the bottom rail 16. The ladder cord 40 is coupled to the tilt drum 38. A tilt rod 36 couples the tilt drum 38 to the tilt actuator 33 which is also mounted in the headrail 14. A tilt wand 34 is coupled to the tilt actuator 33. When an operator rotates the tilt wand 34 in one direction, the tilt actuator 33 moves which in turn rotates the tilt rod 36 and moves the tilt drum 38. Such action either winds or unwinds the ladder cord 40 around the tilt drum 38 which in turn moves the slats of the window covering 18 from one position to another position, typically a horizontal to almost vertical position. Such action adjusts the amount of light allowed to ingress or egress the window. An additional tilt drum 38 and tilt drum bracket 42 may be mounted in the headrail 14 and coupled to the tilt mechanism 22 by an appropriately sized tilt rod 36. (See FIG. 1)

Friction can be provided to the cords 30, 32 coupled to the bottom rail 16 in the window covering slats 18 by use of a one-way tensioning mechanism 24. The tensioning mechanism 24 is configured to provide a resistant force on movement of one of the first and second cords 30, 32 in one direction. As shown in FIG. 1, an additional set of cords 30, 32 are coupled to the bottom rail 16.

Referring to FIG. 3, the one-way tensioning mechanism 24 comprises a mechanism bracket 44 with the mechanism bracket having a base 46 and a first upright 48 and a second upright 54 coupled to the base 46. Each upright 48, 54 defines a respective aperture 52, 58 for slidably and rotatably receiving a pulley 62. Each upright, 48, 54 includes a pawl 60, with one pawl 60 aligned in facing relationship with the other pawl 60. A pulley 62 is mounted between the two uprights 48, 54. The pulley 62 includes a cylinder 64 with a sidewall 70 on each end of the cylinder 64. Each sidewall 70 has an innerface 72 and an outerface 74 with each outerface 74 having a plurality of ratchet teeth 76 configured to selectively engage the pawl 60 on each upright 48, 54. (See FIG. 3)

Figure 4:
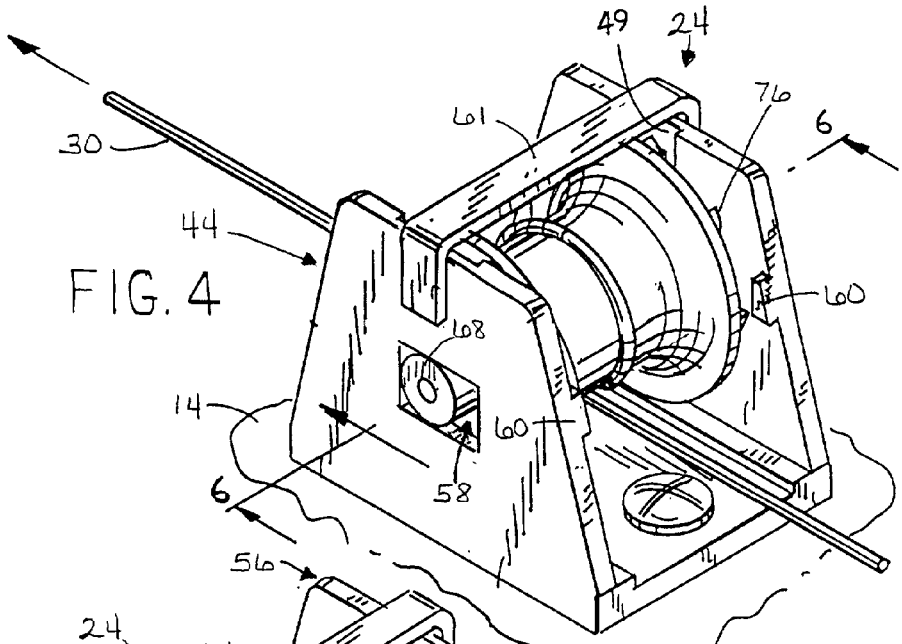
FIG. 4 is a perspective view of an exemplary embodiment of a one-way tensioning mechanism with the pulley in a free-wheeling position within the mechanism bracket.
Figure 5:
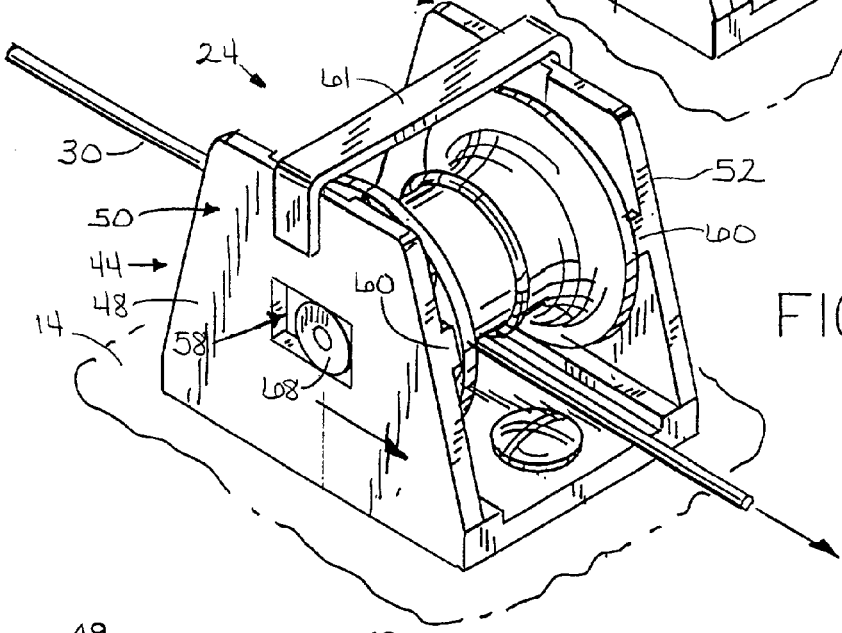
FIG. 5 is a perspective view of the one-way tensioning mechanism of FIG. 4, with the pulley in a stopped position within the mechanism bracket.

Referring to FIGS. 4 and 5, there is shown a perspective view, of a one-way tensioning mechanism 24 mounted on the headrail 14 and coupled to cord 30 in a cordless blind 12. The pulley 62 is configured to move within the apertures 52, 58 to one of a free-wheeling position as shown in FIG. 4 and a stopped position as shown in FIG. 5.

Figure 8:
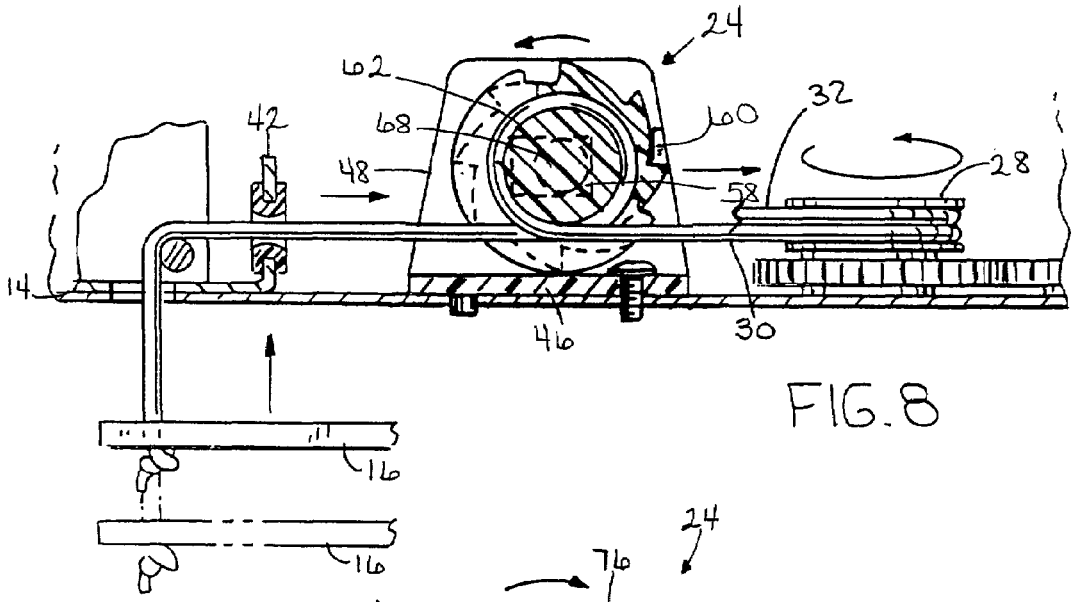
FIG. 8 is a sectional view of the one-way tensioning mechanism illustrated in FIG. 7 with the pulley in the stopped position and bottom rail moving up with the cord winding on a spool and sliding around the stationary pulley cylinder.
Figure 9:
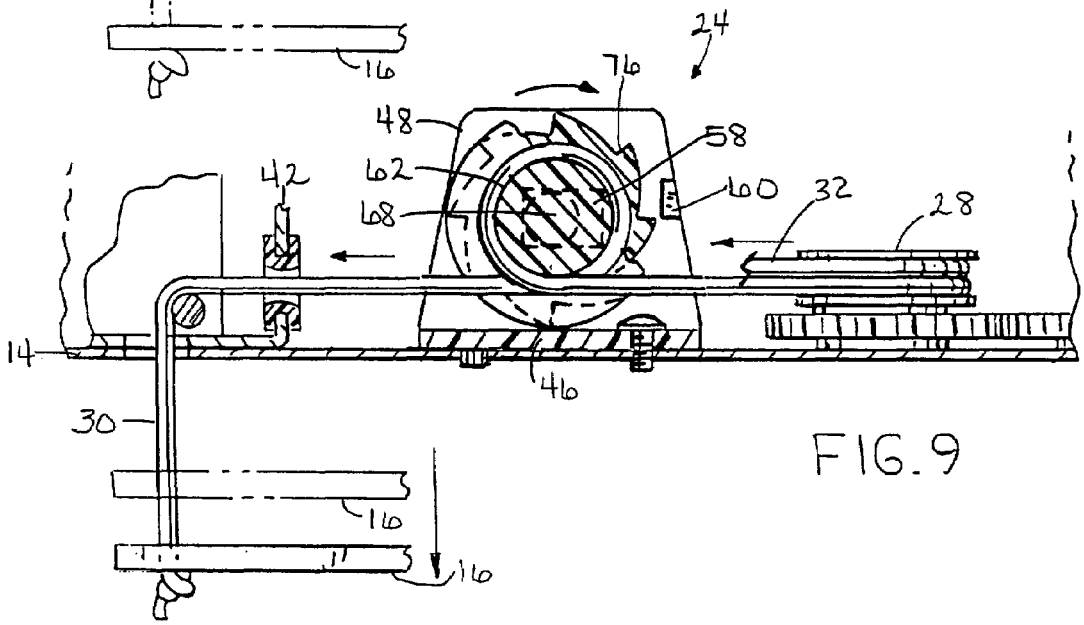
FIG. 9 is a sectional view of the one-way tensioning mechanism illustrated in FIG. 7 with the pulley in the free-wheeling position and the bottom rail moving down.

Referring to FIGS. 8 and 9, FIG. 8 illustrates the one-way tensioning mechanism 24 having the pulley 62 in the stopped position. As the bottom rail is moved upward, the pulley 62 is forced to move laterally within the aperture 52, 58 in the one-way tensioning mechanism 24 until one of the ratchet teeth 76 engages the pawl 60 on each of the uprights 48, 54 of the mechanism bracket 44. With the pulley 62 engaged with the pawl 60, the pulley cannot rotate within the apertures 52, 58 and the pulley 62 is in a stopped position. The cord 30 slides around the cylinder 64 of the pulley 62. Such sliding movement produces a frictional force that acts to balance the forces within the blind 12 and prevent creep. The frictional force can be modified by varying the combination of cord material and pulley composition. As the cord 30 slides around the pulley 62, the cord 30 is collected on the cord spool 28 which is coupled to the spring motor 26.

Referring to FIG. 9, when the bottom rail 16 is pulled down, the cord 30 is unwound from the cord spool 28. As the cord 30 moves down, it forces the pulley 52 to move laterally within the apertures 52, 58 in the one-way tensioning mechanism 24 which disengages the ratchet teeth 76 from the pawl 60 on each of the uprights 48, 54 of the mechanism bracket 44, thereby allowing the pulley 62 to free-wheel.

Figure 6:
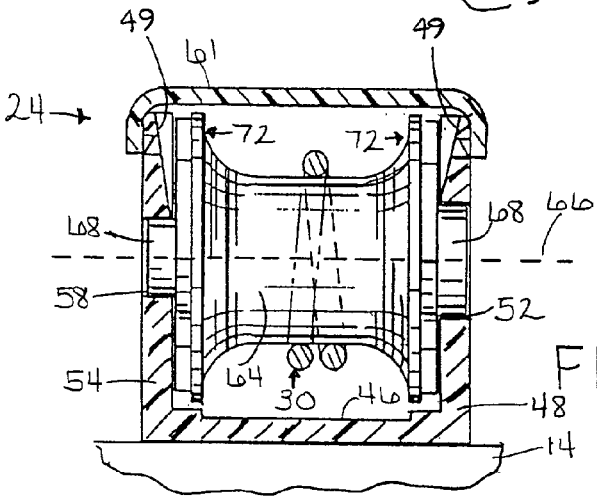
FIG. 6 is a sectional view of the one-way tensioning mechanism illustrated in FIG. 4 along the line 6—6.

The apertures 52, 58 are sized differently from each other. The first upright 48 defines a first aperture 52. The second upright 54 defines a second aperture 58. The exact position of the aperture and size of the apertures 52, 58 are dependent upon the size of the pulley 62 that is mounted in the apertures of the mechanism bracket 44. The pulley 62 includes a longitudinal axis 66 along which an axle 68 is coupled to the cylinder 64 to form the pulley with the sidewalls 70 on each end of the cylinder 64. As shown in FIG. 6, one end of the axle is sized differently from the other end of the axle and each end corresponds to the size of the first and second apertures 52, 58 in which they are inserted in the mechanism bracket 44. The size difference of the axle ends provides a single assembly configuration for mounting the pulley 62 in the mechanism bracket 44 to ensure that the ratchet teeth 76 would properly align for engagement with the pawl 60 when the pulley 62 is moved into the stopped position. Assembly of the pulley 62 in the mechanism bracket 44 can be facilitated by a bevelled ramp 49 in each upright 48, 54, as illustrated in FIGS. 3 and 6. A top cover 61 can be provided to engage the distal ends 50, 56 of each upright 48, 54 of the mechanism bracket 44 as shown in FIGS. 3–6.

The mechanism bracket 44 can be constructed from any convenient material such as metal or plastic and can be machined or formed, such as by molding. However, the material selected for the bracket 44 and pulley 62 will effect the friction required to rotate the pulley in the free-wheeling position. Accordingly, if friction is only desired in one direction to avoid upward creep, the materials of the bracket 44 and pulley 62 should be selected to minimize friction. It is also contemplated that the mechanism base 46 and the first upright 48 and the second upright 54 can be formed as a single integral piece by molding the mechanism bracket 44 from an engineered plastic or other suitable material. The one-way tensioning mechanism can be conventionally mounted in the headrail or bottom rail by the use of fasteners such as screws or rivets or can be coupled to the headrail 14 or bottom rail 16 by a suitable adhesive such as epoxy or glue, Although the one-way tensioning mechanism 24 has been shown mounted in the headrail 14 of the cordless blind 12, it is also contemplated that the one-way tensioning mechanism 24 can be mounted in a suitable bottom rail 16 with the appropriate drive actuator 20 and related mechanisms. In some instances, a second one-way tensioning mechanism 24 configured to provide a resistant force on movement in one direction of the other cord in the cordless blind 12 can be mounted in either the headrail 14 or the bottom rail 16 of the cordless blind 12. It should be noted that the typical cordless blind 12 does have two cords and one cord would be mounted on each one-way tensioning mechanism 24 as described above.

There is also provided a method of providing a resistive force to cords. In a cordless blind 12 with the blind having a headrail 14 and a bottom rail 16 suspended from the headrail 14 by a first cord 30 and a second cord 32 and a window covering 18 disposed between the headrail 14 and the bottom rail 16 with a drive actuator 20 including a spring motor 26 and a spool 28 for accumulating the cords mounted in the cordless blind 12, a one-way tensioning mechanism is installed. One of the first cord and a second cord is wound around a pulley in the one-way tensioning mechanism, with the pulley having a plurality of ratchet teeth. Providing at least one pawl on the tension mechanism with the pawl aligned to selectively engage the ratchet teeth of the pulley wherein the pulley is configured to move within the tensioning mechanism to one of a free-wheeling position and a stopped position. Additional frictional force can be imparted to the cordless blind 12 by installing a second one-way tensioning mechanism and winding the other of the first and second cord around the second pulley, having a plurality of ratchet teeth, mounted in the second one-way tensioning mechanism. The cords 30, 32 are typically wound 1 to 2 times around the pulley cylinder 64. However, the cords may be wound around the pulley more or less depending on the application.

The one-way tensioning mechanism can be mounted in the headrail of the cordless blind or can be mounted in the bottom rail 16 of the cordless blind 12.

Thus, the present invention features a cordless blind or shade in which a spring motor is used to eliminate conventional pull cords and cord lock mechanisms and employs one or more one-way tensioning mechanisms to provide a resistant force on movement of one of the first and second cords in the cordless blind. The term "cordless blind" is not meant as a term of limitation insofar as any blind, shade or like apparatus having a decorative or functional use or application as a window covering or furnishing is intended to be within the scope of the term. The use of the term "cordless blind" is intended as a convenient reference for any blind, shade or structure that does not have cords (example, pull cords) hanging freely for manipulation by the user. It is also important to note that the use of the term "cordless" does not mean that no cords are used within the blind itself. The term "window covering" is intended to include any of the variety of blind arrangements, including horizontal vanes or slats, roller shades, cellular shades, pleated shades, etc.

As a result of the one-way tensioning mechanism, there is increased tension and as a result increased friction in the system when the bottom rail is in a static position. This increased tension and resulting friction aids to prevent upward movement of the bottom rail toward the headrail thereby preventing upward creep. However, as the bottom rail is manually lifted by a user to raise the bottom rail toward the headrail, the tension in the cord is released allowing the cords to slide around the pulley even though the pulley itself is in the stopped position. When the bottom rail is pulled downwards away from the headrail, the pulley moves laterally in the apertures freeing the ratchet from the pawl and permitting the pulley to free-wheel. The result of this system is that friction is applied to the system in only the direction it is needed to prevent upward creep. The system could be modified to allow free-wheeling of the pulley as the bottom rail is being raised and moving the pulley to the stopped position as the bottom rail is being lowered. This arrangement would be desirable if the goal was to prevent creep of the bottom rail in the downward direction.

In the drawings, specific examples, and the particular formulations given and to describe exemplary embodiments of the present invention, serve as the purpose of illustration only. The one-way tensioning mechanism shown and described may differ depending on the chosen performance, characteristics and physical characteristics of the blinds. The systems shown and described are not limited to the precise details and conditions disclosed. For example, other types of one-way tensioning mechanisms may be used. A pulley that only rotates in one direction by use of an internal ratchet and pawl system may be used, or any type of pulley in which movement is inhibited in one direction greater than the opposite direction. Further a tensioning mechanism such as an engagement surface having increased frictional characteristics in one direction, such as a fish scale arrangement may also be employed. Furthermore, other substitutions, modifications, changes and omissions may be made in the design, operation, operating conditions and arrangements of the exemplary embodiments without departing from the scope of the invention as expressed in the appended claims.

What is claimed is:

1. A cordless blind comprising:

a headrail;

a bottom rail suspended from the headrail by a first cord and a second cord;

a window covering disposed between the headrail and the bottom rail;

a drive actuator including:

a spring motor, and a spool for accumulating the cords coupled to the spring motor; and a one-way tensioning mechanism, wherein the tensioning mechanism engages one of the first and second cords to provide a resistant force preventing movement of the one of the first and second cords in one of the direction of the force applied to the one of the cords by the spring motor and the direction of the force of the weight of the bottom rail and an accumulated portion of the window covering supported by the one of the cords, wherein the tensioning mechanism is configured to not provide a resistant force preventing movement of the one of the first and second cords in the opposite direction, and wherein movement of the one of the cords in the one of the directions moves the one-way tensioning mechanism to an engaged position preventing movement of the one of the cords and movement of the one of the cords in the opposite direction moves the one-way tensioning mechanism to a disengaged position permitting movement of the one of the cords.

2. The cordless blind of claim 1, including a second one-way tensioning mechanism configured to provide a resistant force preventing movement in one direction of the other cord, and wherein the second tensioning mechanism is configured to not provide a resistant force preventing movement in the opposite direction of the other cord.

3. The cordless blind of claim 1, wherein the drive actuator is mounted in the headrail.

4. A cordless blind comprising:

a headrail;

a bottom rail suspended from the headrail by a first cord and a second cord;

a window covering disposed between the headrail and the bottom rail;

a drive actuator including:

a spring motor, and a spool for accumulating the cords coupled to the spring motor; and, a one-way tensioning mechanism, wherein the tensioning mechanism is configured to provide a resistant force on movement of one of the first and second cords in one direction, wherein the one-way tensioning mechanism comprises:

a mechanism bracket, with the mechanism bracket having a base and a first upright and a second upright coupled to the base, with each upright defining an aperture and further, each upright including a pawl, with one pawl aligned in facing relationship with the other pawl and, a pulley mounted between the two uprights, with the pulley having a cylinder with a side wall on each end of the cylinder, each sidewall having an inner face and an outer face, with each outer face having a plurality of ratchet teeth configured to selectively engage the pawl on each upright.

5. The cordless blind of claim 4, wherein the pulley is configured to move within the apertures to one of a free-wheeling position and a stopped position.

6. The cordless blind of claim 5, wherein the aperture in the first upright is sized different from the aperture in the second upright.

7. The cordless blind of claim 4, wherein the base and two uprights are formed as a single, integral piece.

8. A one-way tensioning mechanism in a cordless blind with the cordless blind having a headrail, a bottom rail suspended from the headrail by at least a first cord and a second cord, a window covering disposed between the headrail and the bottom rail, a drive actuator including a spring motor, and a spool for accumulating the cords coupled to the spring motor, the one-way tensioning mechanism coupled to one of the first cord and the second cord, the one-way tensioning mechanism comprising:

a mechanism bracket, with the mechanism bracket having a base and a first upright and a second upright coupled to the base, with each upright defining an aperture and further, each upright including a pawl, with one pawl aligned in facing relationship with the other pawl and, a pulley mounted between the two uprights, with the pulley having a cylinder with a side wall on each end of the cylinder, each sidewall having an inner face and an outer face, with each outer face having a plurality of ratchet teeth configured to selectively engage the pawl on each upright, wherein the tensioning mechanism is configured to provide a resistant force on movement of one of the first and second cords in one direction.

9. The one-way tensioning mechanism of claim 8, wherein the spool is configured to move within the apertures to one of a free-wheeling position and a stopped position.

10. The one-way tensioning mechanism of claim 9, wherein the aperture in the first upright is sized different from the aperture in the second upright.

11. The one-way tensioning mechanism of claim 8, wherein the base and two uprights are formed as a single, integral piece.

12. The one-way tensioning mechanism of claim 8, including a second one-way tensioning mechanism configured to provide a resistant force on movement in one direction of the other cord.

13. The one-way tensioning mechanism of claim 8, wherein the drive actuator is mounted in the headrail.

14. A cordless blind comprising:

a headrail;

a bottom rail suspended from the headrail by a first cord and a second cord;

a window covering disposed between the headrail and the bottom rail;

a drive actuator coupled to the cords; and, a means for providing a resistant force engaging one of the first and second cords and preventing movement of the one of the first and second cords in one of the direction of the force applied to the one of the cords by the drive actuator and the direction of the force of the weight of the bottom rail and an accumulated portion of the window covering supported by the one of the cords, wherein the means for providing does not provide a resistant force preventing movement of the one of the first and second cords in the opposite direction, and wherein movement of the one of the cords in the one of the directions moves the means for providing to an engaged position preventing movement of the one of the cords and movement of the one of the cords in the opposite direction moves the means for providing to a disengaged position permitting movement of the one of the cords.

15. The cordless blind of claim 14, wherein the means for providing a resistant force comprises:

a means for supporting, including a means for engaging; and, a means for tensioning coupled to the means for supporting, with the means for tensioning configured to selectively engage the means for engaging.

16. The cordless blind of claim 15, wherein the means for tensioning is configured to move within the means for supporting to one of a free-wheeling position and a stopped position.

17. The cordless blind of claim 16, wherein the means for supporting includes a first aperture and a second aperture with the first aperture sized different from the second aperture.

18. The cordless blind of claim 14, including a second means for providing a resistant force preventing movement in one direction of the other cord, and wherein the second means for providing is configured to not provide a resistant force preventing movement in the opposite direction of the other cord.

19. The cordless blind of claim 14, wherein the drive actuator is mounted in the headrail.

20. The cordless blind of claim 14, including at least one additional drive actuator mounted in the headrail and coupled to the cords.

21. A method of providing a resistant force in a cordless blind, the method comprising:

providing a cordless blind, the blind having a headrail, a bottom rail suspended from the headrail by a first cord and a second cord, a window covering disposed between the headrail and the bottom rail, a drive actuator including a spring motor and spool for accumulating the cords;

installing a one-way tensioning mechanism;

winding one of the first cord and second cord around a pulley, having a plurality of ratchet teeth, mounted in the one-way tensioning mechanism; and providing at least one pawl on the tensioning mechanism, with the pawl aligned to selectively engage the ratchet teeth of the pulley;

wherein the pulley is configured to move within the tensioning mechanism to one of a free-wheeling position and a stopped position.

22. The method of claim 21, including the steps of installing a second one-way tensioning mechanism and winding the other of the first and second cord around a second pulley, having a plurality of ratchet teeth, mounted in the second one-way tensioning mechanism.

23. The method of claim 21, wherein the one-way tensioning mechanism is mounted in the headrail.

24. A cordless blind comprising:

a headrail;

a bottom rail operatively coupled to the headrail with at least one cord;

a window covering disposed between the headrail and the bottom rail; and a pulley operatively engaged with the cord and being rotatable in only one direction, wherein the pulley does not provide a resistive force preventing movement of the cord when the pulley rotates in the one direction, and provides a resistive force preventing movement of the cord when the tension on the cord would cause the pulley to rotate in the opposite direction.

25. The cordless blind of claim 24, wherein the pulley is mounted in a mechanism bracket, with the bracket configured for the pulley to move to one of a free-wheeling position and a stopped position.

26. The cordless blind of claim 24, including a second cord attached to the bottom rail and operatively coupled to the headrail; and a second pulley operatively engaged with the second cord and being rotatable in only one direction.

27. The cordless blind of claim 24, wherein the pulley is mounted in the headrail.

28. A cordless blind comprising:

a headrail;

a bottom rail operatively coupled to the headrail with at least one cord;

a window covering disposed between the headrail and the bottom rail; a drive actuator for accumulating the at least one cord; and a tensioner operatively engaged with the cord applying a first frictional force preventing movement of the cord in one of the direction of a force applied to the cords by the drive actuator and the direction of the force of the weight of the bottom rail and an accumulated portion of the window covering supported by the one of the cords, wherein the tensioner does not prevent movement of the cord in the opposite direction, and wherein movement of the cord in the one of the directions moves the tensioner to an engaged position preventing movement of the cord and movement of the cord in the opposition direction moves the tensioner to a disengaged position permitting movement of the cord.

29. The cordless blind of claim 27, including a second cord operatively coupled to the bottom rail and headrail; and a second tensioner operatively engaged with the second cord applying a second frictional force preventing movement of the second cord in only one direction.

30. The cordless blind of claim 28, wherein the tensioner is mounted in the headrail.

* * * * *